US010704295B2

(12) United States Patent
Miller

(10) Patent No.: US 10,704,295 B2
(45) Date of Patent: Jul. 7, 2020

(54) ELECTRO-MECHANICAL LOCK AND INSTALLATION METHOD HAVING INTEGRATED ELECTRICAL CONDUCTOR

(71) Applicant: Lock II, LLC, Nicholasville, KY (US)

(72) Inventor: J. Clayton Miller, Nicholasville, KY (US)

(73) Assignee: Lock II, LLC, Nicholasville, KY (US)

( * ) Notice: Subject to any disclaimer, the term of this patent is extended or adjusted under 35 U.S.C. 154(b) by 12 days.

(21) Appl. No.: 16/225,516

(22) Filed: Dec. 19, 2018

(65) Prior Publication Data

US 2019/0169879 A1 Jun. 6, 2019

Related U.S. Application Data

(63) Continuation of application No. PCT/US2018/063832, filed on Dec. 4, 2018.

(60) Provisional application No. 62/594,268, filed on Dec. 4, 2017.

(51) Int. Cl.
*E05B 47/00* (2006.01)
*E05B 49/00* (2006.01)
*E05B 17/22* (2006.01)

(52) U.S. Cl.
CPC ..... *E05B 47/0012* (2013.01); *E05B 47/00* (2013.01); *E05B 49/00* (2013.01); *E05B 17/226* (2013.01); *E05B 2047/005* (2013.01); *E05B 2047/0057* (2013.01); *E05B 2047/0088* (2013.01)

(58) Field of Classification Search
CPC ..... E05B 47/0012; E05B 47/00; E05B 49/00; E05B 2047/0057; E05B 17/226; E05B 2047/0088; E05B 2047/005
USPC .. 70/277, 278.1, 278.4, 278.5, 278.6, 278.7, 70/279.1, 280–282, 320, 329, 331, 332, 70/303 R, 303 A, 442–446; 340/5.55
See application file for complete search history.

(56) References Cited

U.S. PATENT DOCUMENTS 4,691,544 A * 9/1987 Beattie ..... E05B 37/08 70/326
5,887,467 A * 3/1999 Butterweck ..... E05B 41/00 292/144
6,116,066 A * 9/2000 Gartner ..... E05B 41/00 292/348

(Continued)

OTHER PUBLICATIONS

International Searching Authority, Search Report and Written Opinion issued in International Application No. PCT/US18/63832 dated Feb. 21, 2019 (8 pages).

*Primary Examiner* — Lloyd A Gall
(74) *Attorney, Agent, or Firm* — Dorton & Willis, LLP

(57) ABSTRACT

An electro-mechanical lock is provided for a door. The lock includes inner and outer lock components mounted on opposite sides of the door and a tube extending between the inner and outer lock components, the tube being configured to receive a spindle extending through the door. The tube includes an electrical conductor integrated with the tube as a one-piece construction for transmitting electrical power and/or control signals between first and second electrical connectors at the inner and outer lock components. The tube is less fragile than conventional double tube arrangements in locks and thus can be more easily cut to length and installed at the door, improving reliability and cost effectiveness of methods of installation.

20 Claims, 9 Drawing Sheets

(56) References Cited

U.S. PATENT DOCUMENTS

| | | | | |
|---|---|---|---|---|
| 6,264,256 | B1 * | 7/2001 | Hankel | E05B 47/0615 292/336.3 |
| 7,591,160 | B2 * | 9/2009 | Keller | E05B 47/0642 70/277 |
| 8,091,392 | B2 * | 1/2012 | Miller | E05B 9/00 70/333 A |
| 8,093,986 | B2 * | 1/2012 | Harvey | E05B 37/00 340/5.21 |
| 8,635,893 | B2 * | 1/2014 | Miller | E05B 49/00 70/283 |
| 9,663,972 | B2 | 5/2017 | Ullrich et al. | |
| 9,777,511 | B2 * | 10/2017 | Taylor | E05B 49/00 |
| 9,816,294 | B2 | 11/2017 | Burrus et al. | |
| 2006/0065027 | A1 * | 3/2006 | Valentine | E05B 47/0657 70/278.1 |
| 2007/0056339 | A1 * | 3/2007 | Irgens | E05B 49/00 70/312 |
| 2007/0157684 | A1 | 7/2007 | Bogdanov et al. | |
| 2011/0283756 | A1 * | 11/2011 | Nilsson | E05B 17/22 70/278.1 |
| 2014/0109633 | A1 * | 4/2014 | Romero | E05B 47/0684 70/133 |

* cited by examiner

ELECTRO-MECHANICAL LOCK AND INSTALLATION METHOD HAVING INTEGRATED ELECTRICAL CONDUCTOR

CROSS-REFERENCE TO RELATED APPLICATION

This application is a continuation of International Application No. PCT/US2018/063832, filed Dec. 4, 2018, which claims the benefit of U.S. Provisional Application Ser. No. 62/594,268, filed Dec. 4, 2017, the disclosures of which are incorporated by reference herein.

TECHNICAL FIELD

The invention relates to electro-mechanical locks and methods for installing such electro-mechanical locks, and more particularly, relates to locks in which a tubular structure contains the spindle extending from an outer lock bolt moving element of the lock (such as a dial) to an inner lock body housing.

BACKGROUND

Documents of an extremely sensitive nature and items having a high proprietary value often need to be stored within a safe or other structure. The structure typically includes a lock mechanism, and the structure is generally designed to be accessible only by a select few individuals who are entrusted with a predetermined combination code that facilitates the unlocking of the mechanism. As more sophisticated lock picking and security feature defeating methods have been developed, the types of lock mechanisms have also developed to become more robust and secure.

Electro-mechanical locks, such as used on safe doors or other cabinets and structures needing security typically include wiring extending between inner and outer portions of the lock. For example, an outer portion of the lock may be a housing with a dial and/or another user input device for allowing the user to input a combination code to the lock. The dial may be used both for inputting the combination and, after the correct combination code is input, for then retracting the lock bolt. The wiring extends through the door, or other access member of the structure such as a cabinet drawer panel and carries voltage for powering one or more inner lock components and for carrying electronic signals such as those used in connection with the combination code. The electrical wiring, such as a ribbon cable in one example, is susceptible to damage. Moreover, because the doors or other access members of different lock installations will have different thicknesses, this part of the lock installation process can be tedious as a result of managing the length and positioning of the electrical wiring as well as the matching of the length of these components to the thickness of the door/lock.

In some conventional lock designs, two thin-walled stainless steel tubes are used in a tube-within-a-tube configuration (hereinafter "double tube arrangement") and a ribbon cable is located between the two tubes. The ribbon cable is positioned to extend lengthwise along the inner tube and the outer tube is then inserted over the ribbon cable in a generally concentric (or tube-within-a-tube) fashion to form the double tube arrangement, with any excess of the ribbon cable projecting from the tube typically stored within the outer lock housing. By placing the ribbon cable between the steel tubes, the ribbon cable is configured to be protected from abrasion and any RF emissions are contained/protected. The lock spindle extends through the inner tube from the outer lock housing to the inner lock housing. These tubes each must be cut to a precise length matching the thickness of the door on which the lock is being installed.

This cutting and installation of the lock is a difficult process for two reasons. First, the measurement must be exact and, second, the tubes have a very thin wall and therefore a very fine tooth saw must be used to cut them. It may also be required to supply a specially-formed holding block for securely holding the components to be cut with the saw, and a grinding stone to remove any burrs or discontinuities formed during the cutting process. Too often, the relatively fragile ribbon cable located between the tubes in the double tube arrangement gets damaged during the cutting or grinding steps and must be replaced during the installation process. In general, such errors can add too much time, expense and complexity to the installation process.

Consequently, it would be desirable to improve the design of the electro-mechanical lock to provide the electrical wiring or communication in a more reliable and cost-efficient manner.

SUMMARY

Various problems and costs, such as those described above and/or others are mitigated by fabricating a tube with integrated electrical conductors running the length of the tube and providing the same in an electro-mechanical lock for a door. To this end, the lock in one embodiment includes an inner lock component with a lock bolt movable between extended and retracted positions and a first electrical connector configured to send and receive electrical power and/or control signals. The lock also includes an outer lock component including a lock bolt moving element operatively coupled to a rotatable spindle, a user input device for providing control signals to selectively allow the lock bolt to be moved to the retracted position when a correct code is entered at the user input device, and a second electrical connector configured to send and receive electrical power and/or control signals. A tube extends between the inner and outer lock components, with the spindle extending through the tube when the lock is fully assembled. The tube includes at least one electrical conductor integrated with the tube as a one-piece construction and configured to transmit electrical power and/or control signals between the first and second electrical connectors.

When installing the lock in accordance with this embodiment, the process is substantially quicker, easier, and less prone to error. The tube is not as fragile or difficult to handle as the wires or ribbon cable used with conventional double tube arrangements. If RF protection is a requirement, the tube can have a foil casing or layer included as part of the fabrication process.

In one aspect, at least one electrical conductor is fixed in position on an inner surface of the tube. Each of the first and second electrical connectors may include at least one electrical contact positioned to extend into a corresponding end of the tube when the lock is fully assembled. The electrical contact thus is in position to contact and operatively connect with at least one electrical conductor of the tube.

In a further aspect, a plurality of electrical conductors is provided on the tube and a plurality of electrical contacts are provided at each of the first and second electrical connectors. The plurality of electrical conductors is spaced around a circumference of the tube, for example.

In another aspect, the tube and the first and second electrical connectors include orientation structures that ensure that the electrical contacts are properly engaged with the electrical conductors of the tube when the lock is fully assembled. In one example, the orientation structures include a key extending from one end of the tube or the first electrical connector, and a keyway formed in the other of the one end of the tube or the first electrical connector. The key and keyway are configured to engage one another only when the tube is properly oriented relative to the first electrical connector. In another example, the orientation structures include an orientation projection extending from the second electrical connector in the same direction as the lock bolt extends from the inner lock component when the lock is fully assembled. The orientation structures on the tube itself may be located along only a first end of the tube such that the opposite second end of the tube can be cut to match a thickness of the door. Other examples for orientation structures are possible, including examples like a ridge along the tube that aligns with corresponding structure to assure proper electrical connections.

In one aspect, at least one electrical conductor and the tube are integrally formed as a unitary piece to provide the one-piece construction. To this end, the tube is formed from at least one of a fiberglass and epoxy structure, an extruded plastic material, or a metallic material. The electrical conductor also includes at least one metallic element extending along the length of the tube.

In another aspect, at least one electrical conductor and the tube are physically fixed together to provide the one-piece construction.

In some embodiments, the outer lock component includes a dial defining both the lock bolt moving element and the user input device. The outer lock component can also include a display unit configured to provide feedback to a user regarding whether the correct code has been entered. In other embodiments, the user input device of the outer lock component is defined by a touch pad.

In another embodiment according to this invention, a method is provided for installing an electro-mechanical lock on a door. The method includes positioning an inner lock component on an inner side of the door and positioning an outer lock component on an outer side of the door. The method also includes extending a tube between the inner and outer lock components, the tube including at least one electrical conductor integrated with the tube as a one-piece construction. A spindle is then positioned in the tube to extend through a length of the tube. The method further includes coupling a first electrical connector to a first end of the tube within the inner lock component and coupling a second electrical connector to a second end of the tube within the outer lock component. Electrical power and/or control signals are directed between the first and second electrical connectors along the length of the tube using at least one electrical conductor.

In one aspect, the step of coupling the first electrical connector to the first end of the tube includes connecting at least one first electrical contact extending from the first electrical connector with at least one electrical conductor. This step further includes aligning at least one first electrical contact with at least one electrical conductor by engaging a key and keyway formed on the first end of the tube and on the first electrical connector.

In another aspect, the step of coupling the second electrical connector to the second end of the tube includes contacting at least one second electrical contact extending from the second electrical connector with at least one electrical conductor. The method also includes installing the second electrical connector into the outer lock component such that an orientation projection extends in the same direction as the lock bolt, and this assures alignment of at least one second electrical contact with at least one electrical conductor when the lock is fully assembled.

In a further aspect, the method includes cutting the tube to match a thickness of the door. The tube therefore extends between the inner and outer lock components on the opposite inner and outer sides of the door.

Various additional objectives, advantages, and features of the invention will be appreciated from a review of the following detailed description of the illustrative embodiments taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
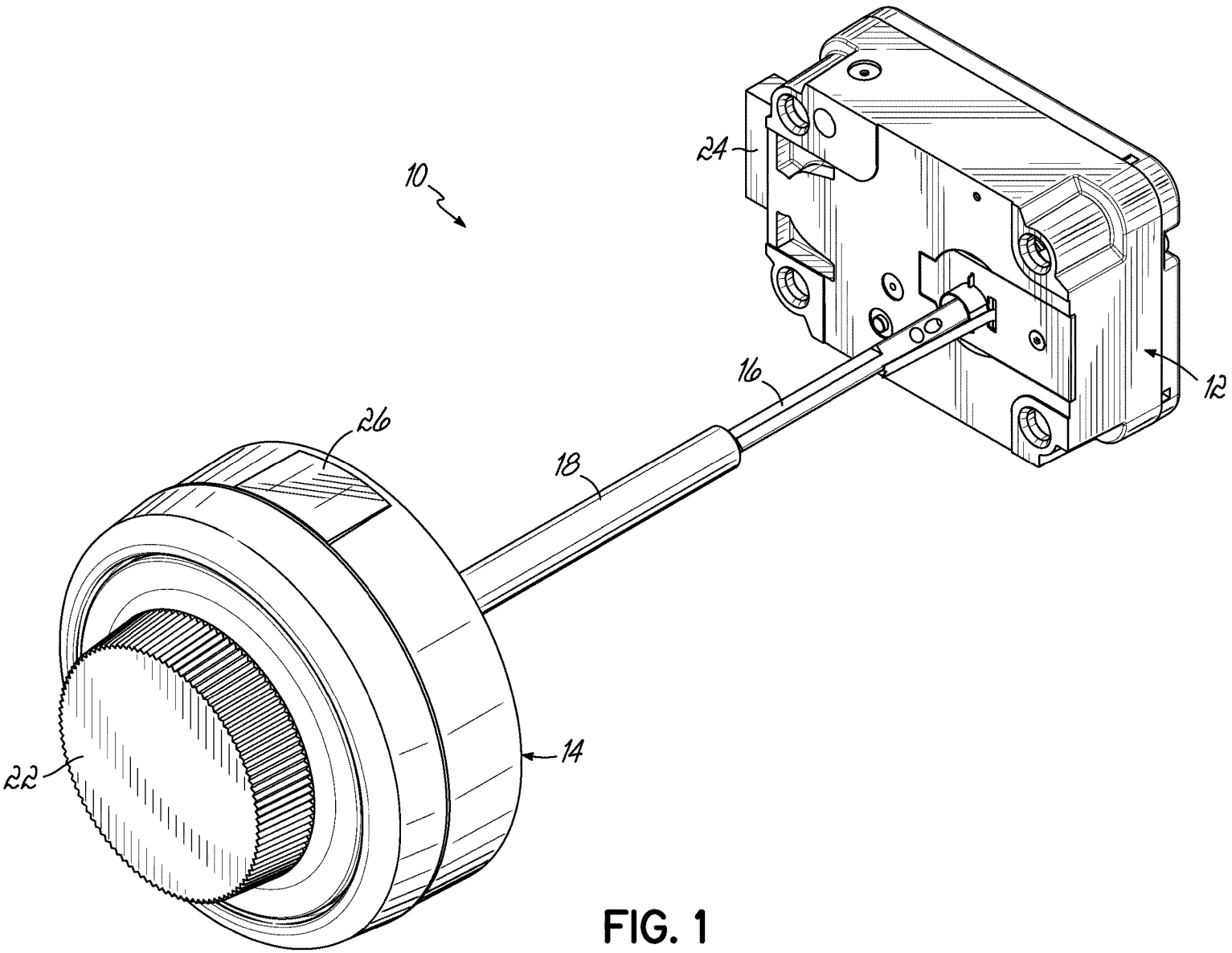
FIG. 1 is a partially disassembled perspective view showing a lock constructed in accordance with an illustrative embodiment of the invention.

With reference to FIGS. 1 through 8, an electro-mechanical lock 10 and method of installation are provided in accordance with this invention for improving the assembly and installation process for such lock mechanisms. To this end, the lock 10 includes an inner lock component 12 and an outer lock component 14 configured to be on opposite sides of a door, with a spindle 16 extending between and operatively connecting these elements. The spindle 16 is housed within a tube 18 that advantageously includes an integrated electrical conductor 20 that is configured to transfer electrical signals or power between the inner and outer lock components 12, 14. With the electrical conductor 20 not being provided as a separate element loosely sandwiched between two tubes in a double tube arrangement, as was conventionally done in such lock designs, the tube 18 for the spindle 16 can be more easily cut to size for the door that the lock 10 is being installed on, and the overall installation process is more cost-effective and easy to perform than conventional lock designs and methods. Thus, the reliability of the electro-mechanical lock 10 and its installation process is improved by the embodiments of this invention.

Figure 2:
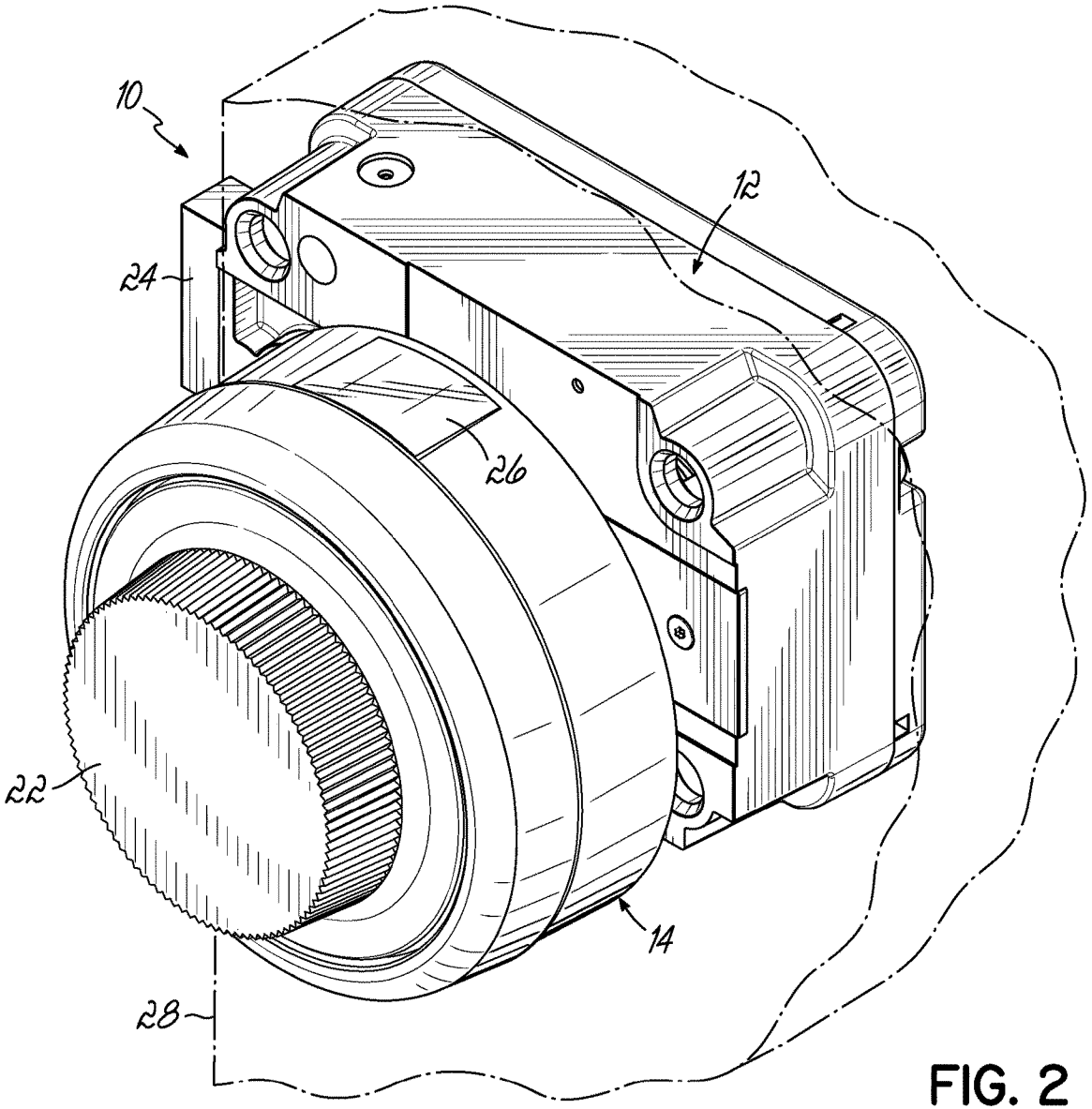
FIG. 2 is an assembled perspective view showing the lock of FIG. 1 installed with a door or other access member between the outer lock component and the inner lock component.

Now turning with reference first to FIGS. 1 and 2, the lock 10 is shown constructed in accordance with one illustrative embodiment. Generally, the lock 10 includes the outer lock component 14 and the inner lock component 12. A lock bolt moving element in the form of a dial 22 is provided at the outer lock component 14 and is configured to rotate relative to the outer lock component 14 to enable entry of an unlocking combination code by the user. The spindle 16 mechanically couples the dial 22 to a lock bolt retraction structure (not shown) contained within the inner lock component 12. It will be appreciated that rotation of the spindle 16 by way of the dial 22 will allow a user to retract the lock bolt 24 of the inner lock component 12 when a proper combination code is input to the outer lock component 14. In this regard, the lock bolt retraction structure is configured (as understood in the lock arts) to selectively engage with the spindle 16 when a correct combination code is entered such that the dial 22 can then be used to retract the lock bolt 24 and unlock the door 28. Specifically, in this embodiment, the dial 22 may be used to both generate electrical power for use within the inner lock component 12 and allow a user to electronically input a correct combination code which is displayed in a display unit 26 of the outer lock component 14, e.g., the dial 22 also serves as a user input device for the lock 10. It will be appreciated that any other user input device or means for inputting unlocking information may be used instead in other embodiments of this invention, including, for example, a touch pad or a digital interface, and in such embodiments, alternative structures for a lock bolt moving element may also be provided. It will be appreciated that both electrical power and electronic signals may be conveyed from the outer lock component 14 into the electrical components, which may include any or all of bolt retraction components, electric components and/or control components contained within the inner lock component 12. In accordance with this embodiment, the tube 18 is provided to both contain the spindle and provide the electrical conductor pathways between the outer lock component 14 and the inner lock component 12. In FIG. 1, the spindle 16 is shown only partially extending into the tube 18 in the disassembled view, while in FIG. 2, the spindle 16 is contained within the tube 18 when the lock 10 is fully assembled and installed at the door 28 (shown in phantom).

Figure 3A:
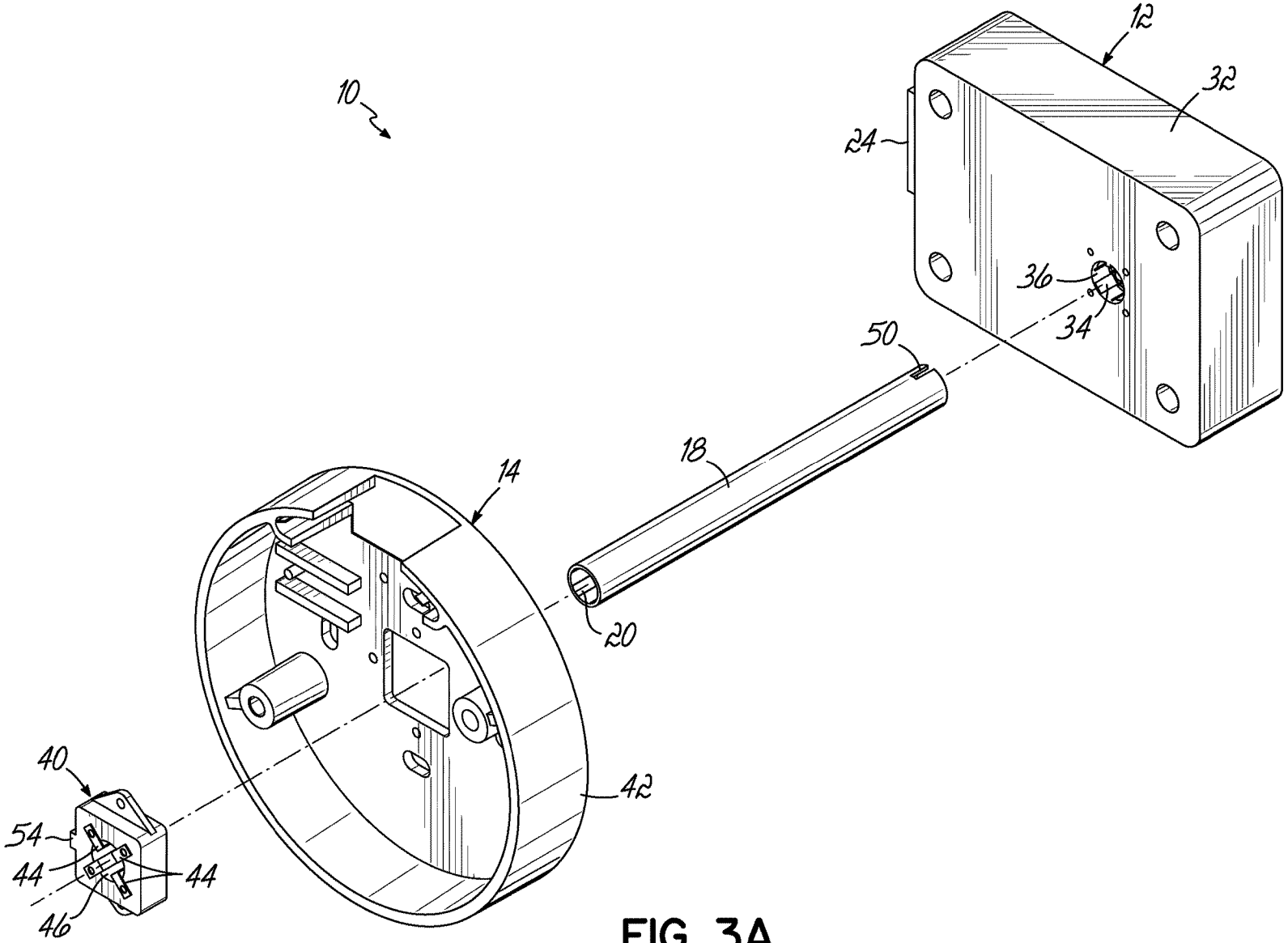
FIG. 3A is a disassembled perspective view showing various components of the lock.
Figure 3B:
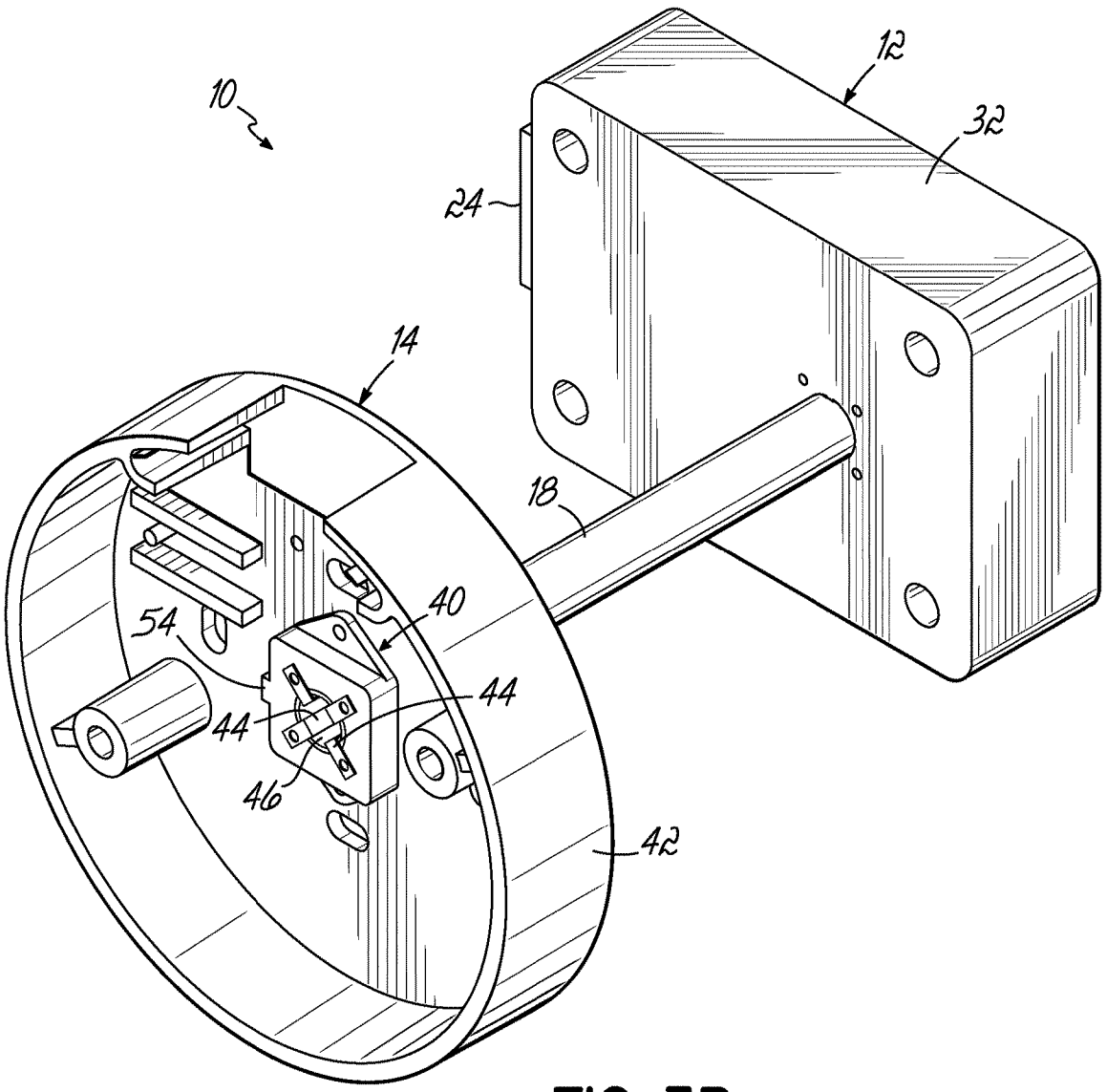
FIG. 3B is an assembled perspective view similar to FIG. 3A, but illustrating the components assembled together.
Figure 4A:
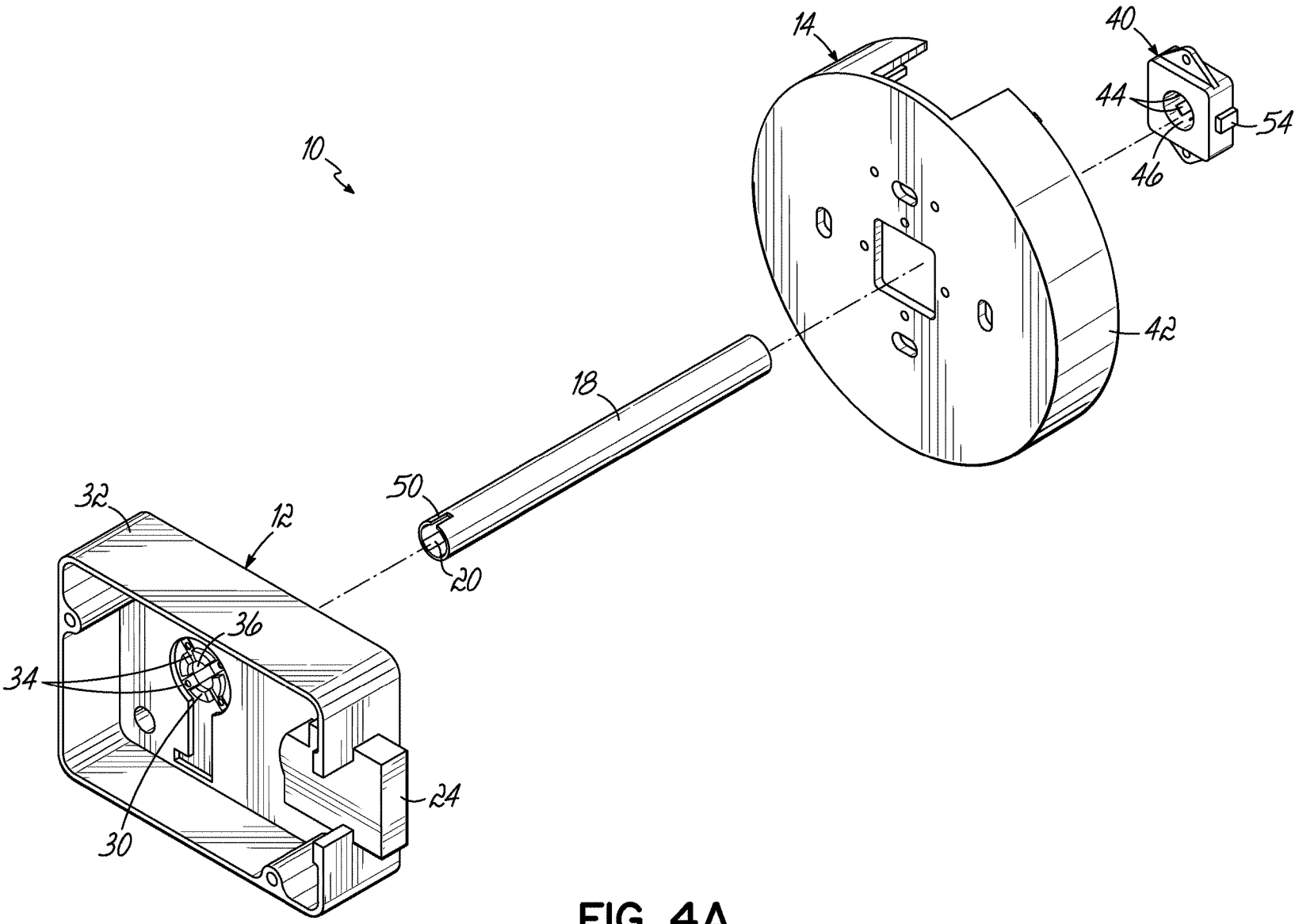
FIG. 4A is a disassembled perspective view similar to FIG. 3A but illustrating the components from an opposite orientation.
Figure 4B:
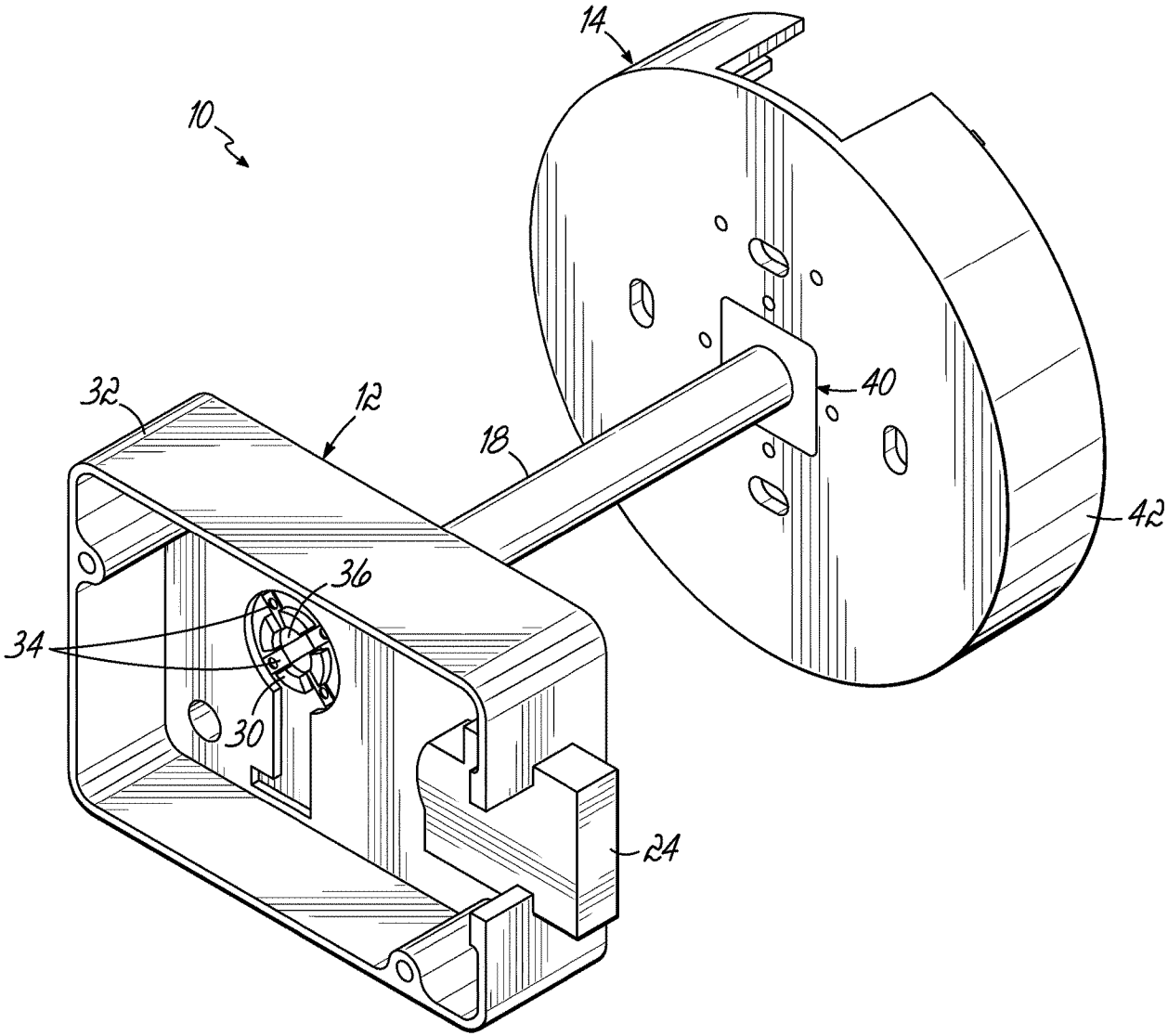
FIG. 4B is an assembled perspective view of the components shown in FIG. 4A.

Now turning to FIGS. 3A, 3B, 4A and 4B, the inner and outer lock components 12, 14 are shown in further detail with some components (including dial 22 and spindle 16) removed such that internal features interacting with the spindle 16 and the tube 18 are visible. As shown in these Figures, the tube 18 connects at opposite ends with respective electrical connectors. To this end, the inner lock component 12 includes a first electrical connector 30 configured to be secured to (or integrated with) an inner housing 32 defined by the inner lock component 12. The first electrical connector 30 includes a series of first electrical contacts 34 projecting radially inwardly and then longitudinally towards the outer lock component 14 in the fully assembled position. More specifically, the first electrical contacts 34 project into a spindle aperture 36 formed in the inner housing 32 and configured to receive the corresponding ends of the spindle 16 and the tube 18. In this embodiment, the first electrical contacts 34 are positioned such that when the spindle 16 and the tube 18 are inserted into the spindle aperture 36 as shown in FIG. 4B, the tube 18 surrounds the first electrical contacts 34 in a radial direction while the spindle 16 extends through the middle of the first electrical contacts 34. This positioning allows the electrical conductors 20, formed on the inner surface of the tube 18 in this embodiment, to come into contact with the first electrical contacts 34 when the lock 10 is assembled.

In a similar manner, the outer lock component 14 includes a second electrical connector 40 configured to be secured to an outer housing 42 defined by the outer lock component 14. The second electrical connector 40 includes a series of second electrical contacts 44 projecting radially inwardly and then longitudinally towards the inner lock component 12 in the fully assembled position. More specifically, the second electrical contacts 44 project into a spindle aperture 46 formed in the outer housing 42 and configured to receive the corresponding ends of the spindle 16 and the tube 18. In this embodiment, the second electrical contacts 44 are positioned such that when the spindle 16 and the tube 18 are inserted into the spindle aperture 46 as shown in FIG. 3B, the tube 18 surrounds the second electrical contacts 44 in a radial direction while the spindle 16 extends through the middle of the second electrical contacts 44. This positioning allows the electrical conductors 20 to come into contact with the second electrical contacts 44 when the lock 10 is assembled. Although not shown in these views, it will be understood that the first and second electrical contacts 34, 44 are operatively coupled or wired into connection (via the first and second electrical connectors 30, 40) with the various conventional electronic and control elements within the lock 10, such as the display unit 26 and/or a controller (not shown).

Figure 8:
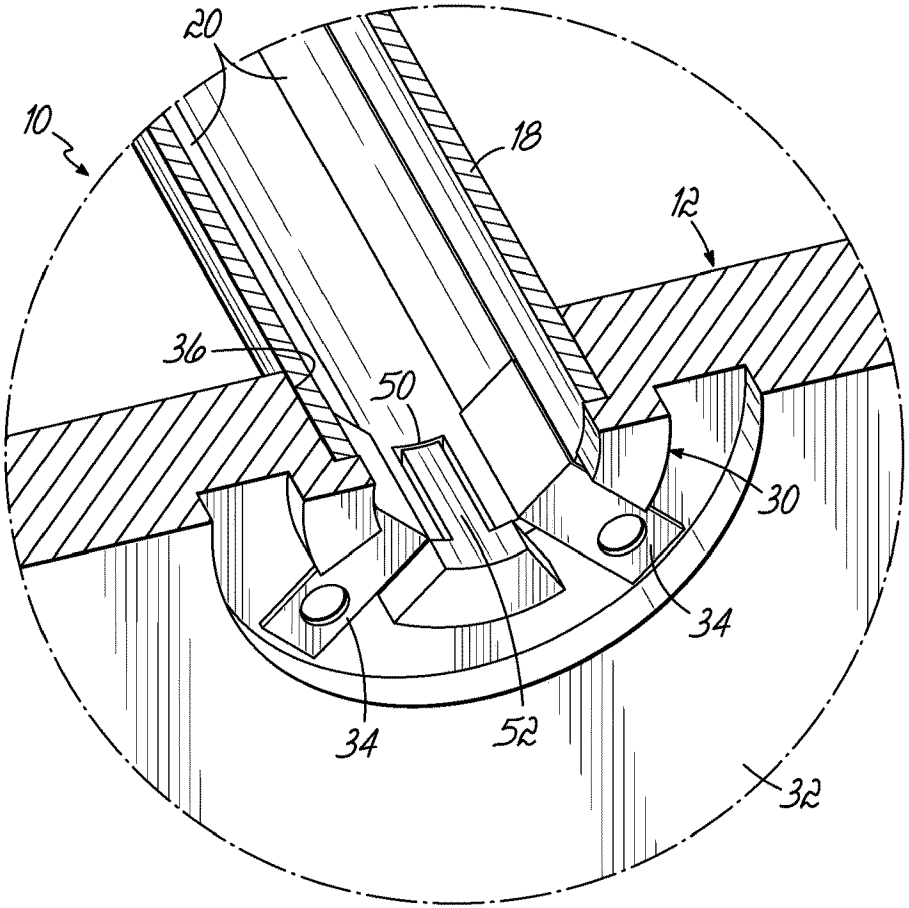
FIG. 8 is a bottom, partially sectioned, perspective view showing the connection between the tube and the electrical connector associated with the inner lock component.

In summary, the electrical connectors 30, 40 have the electrical contacts 34, 44 that physically mate with the electrical conductors 20 extending along the length of the tube 18. It will be appreciated that one or more of these electrical conductors 20 of the tube 18 will be for directing electrical power and one or more other electrical conductors 20 of the tube 18 will be for conducting electronic control signals. Therefore, the installer must ensure that the proper electrical contacts 34, 44 of the electrical connectors 30, 40 associated with the outer lock component 14 and the inner lock component 12 are properly mated with the corresponding electrical conductors 20 of the tube 18. For this purpose, the tube 18 in this embodiment includes at least one orientation structure. For example, the orientation structure is a keyway 50 on one end of the tube 18 for enabling mating with the first electrical connector 30 of the inner lock component 12, but only in the correct orientation. That is, the first electrical connector 30 includes a key 52 integrated into its structure, as best shown in FIG. 8, for mating with the keyway 50. In the embodiment shown in FIGS. 3A and 8, the keyway 50 is a generally linear notch cut into one end of the tube 18 and the key 52 is a projecting portion of the first electrical connector 30 sized to be received within the keyway 50, these elements being inserted into one another in FIG. 8. This set of features ensures that the electrical contacts associated with power are physically coupled to the electrical pathways of the tube 18 that are likewise associated with electrical power and, conversely, the electrical contacts associated with sending control signals are physically mated with the electrical pathways of the tube 18 that are likewise associated with directing electrical control signals. It will be understood that other shapes and sizes of keyway/key and other types of orientation structure may be used in other embodiments to properly orient the tube 18 relative to the first electrical connector 30 of the inner housing 32. For example, one other type of orientation structure (not shown) is a raised ridge or element extending along the length of the tube 18 that will fit within respective recesses or keyways in the respective electrical connectors 30, 40 or other portions of the inner and outer housings 32, 42.

Figure 5:
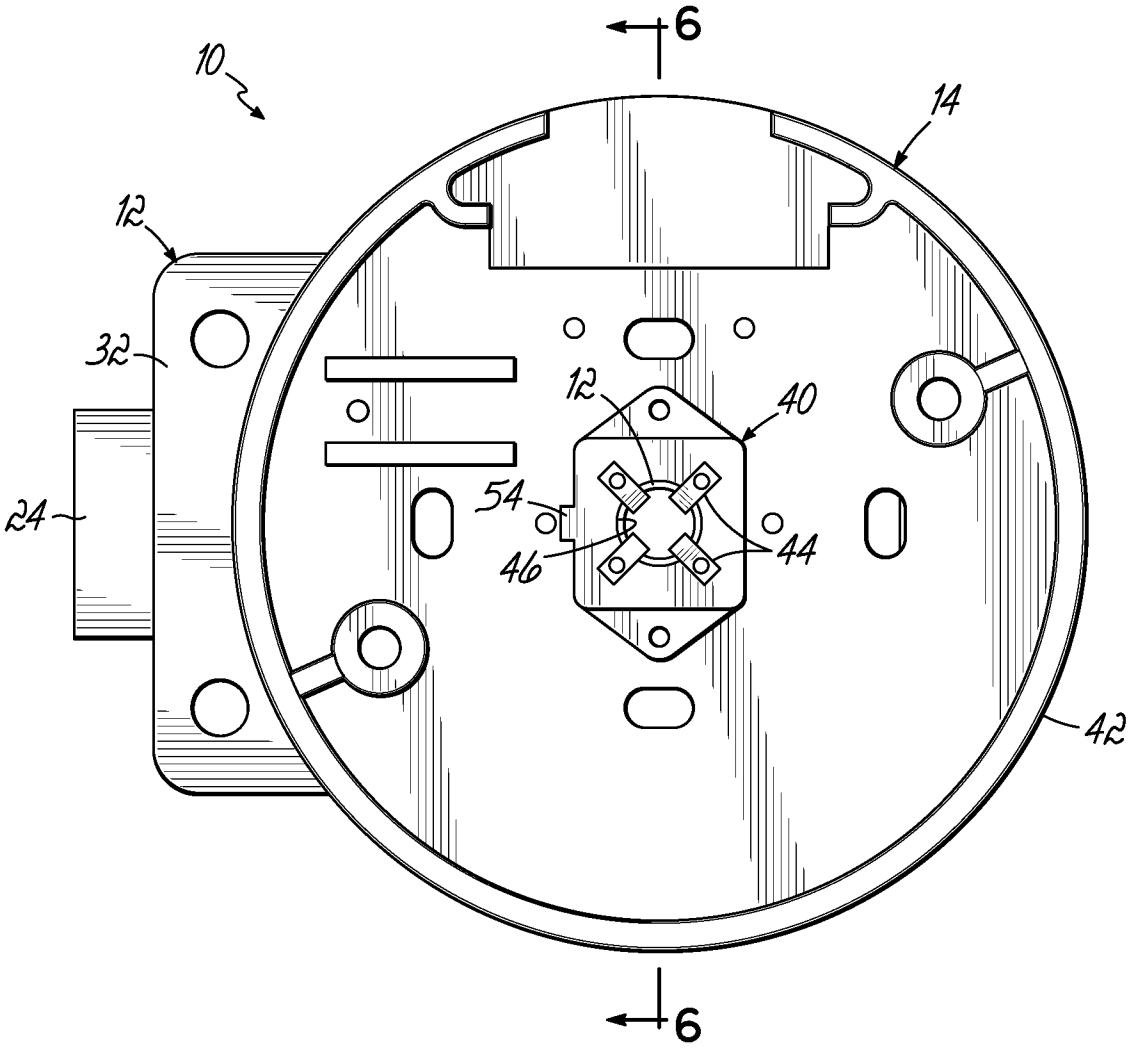
FIG. 5 is an end view or plan view of the assembled lock taken from the outer lock component or panel end.

Depending on the size or thickness of the door 28 that the lock 10 is installed on, the tube 18 generally needs to be cut to match the size or thickness of the door 28. As a result, the opposite end of the tube 18 that interacts with the outer lock component 14 in this embodiment cannot be formed with its own orientation structure. Instead, at the opposite end of the tube 18, the second electrical connector 40 includes an orientation projection 54 that the installer will use to ensure that this second electrical connector 40 is oriented properly in a rotational or angular sense. That is, the second electrical connector 40 must be oriented in this embodiment such that the orientation projection 54 extends in the same direction as the lock bolt 24. This will ensure that the second electrical contacts 44 of that second electrical connector 40 will be properly mated with the electrical conductors 20 of the tube 18. This orientation projection 54 is best shown in FIGS. 3A, 3B and 5 as being directed in the same orientation or direction as the lock bolt 24. In this regard, the second electrical connector 40 is mounted on a separate body having the orientation projection 54 and fastener apertures such that the separate body can be coupled with the outer housing 42 as will be readily understood by those skilled in the lock arts. The orientation projection 54 may be modified in other embodiments of the invention, so long as the installer is provided with some guidance for properly orienting the second electrical connector 40 for connection to the tube 18 and the electrical conductors 20 therein.

Figure 6:
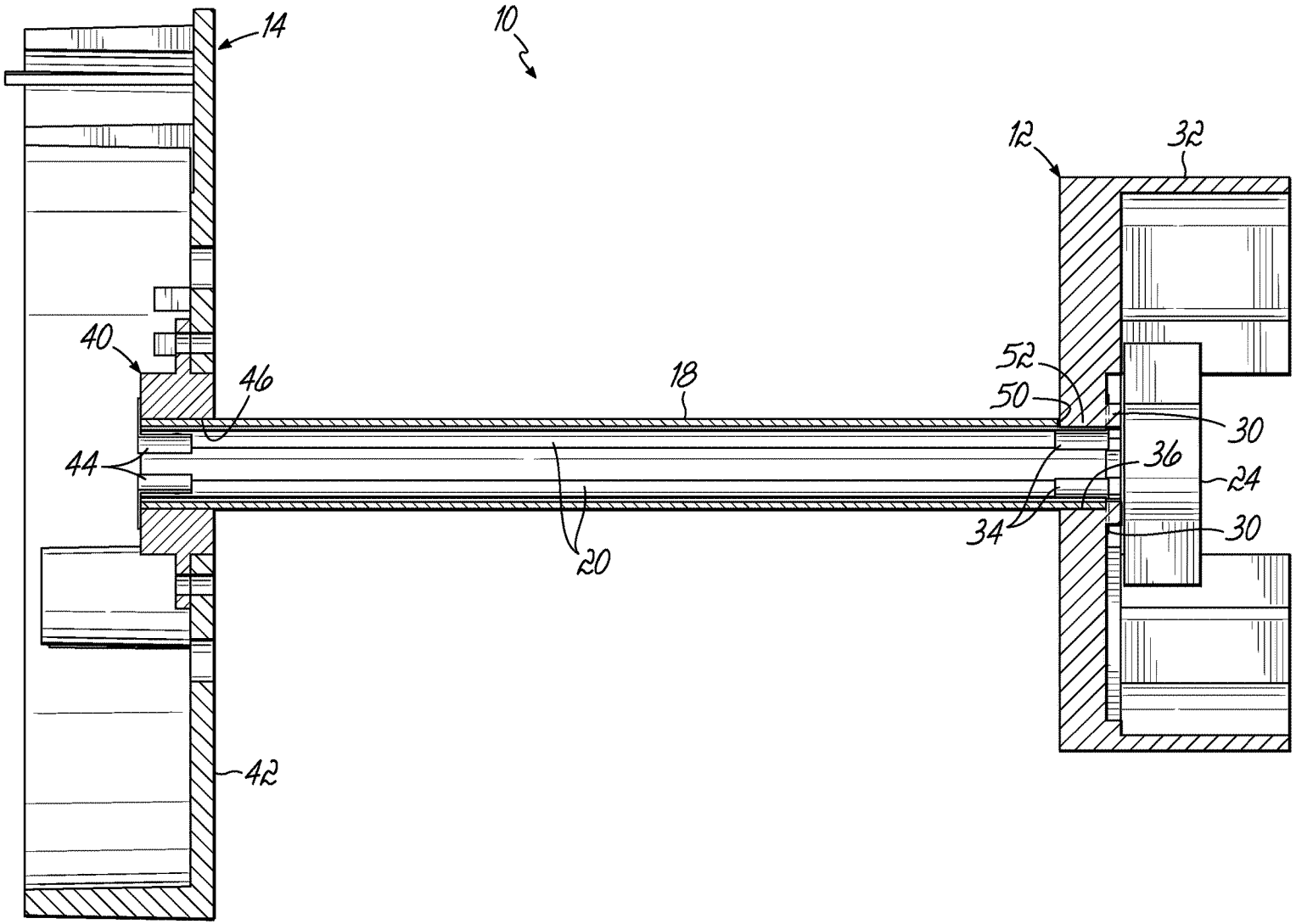
FIG. 6 is a cross sectional view of the lock taken along line 6-6 of FIG. 5.
Figure 7:
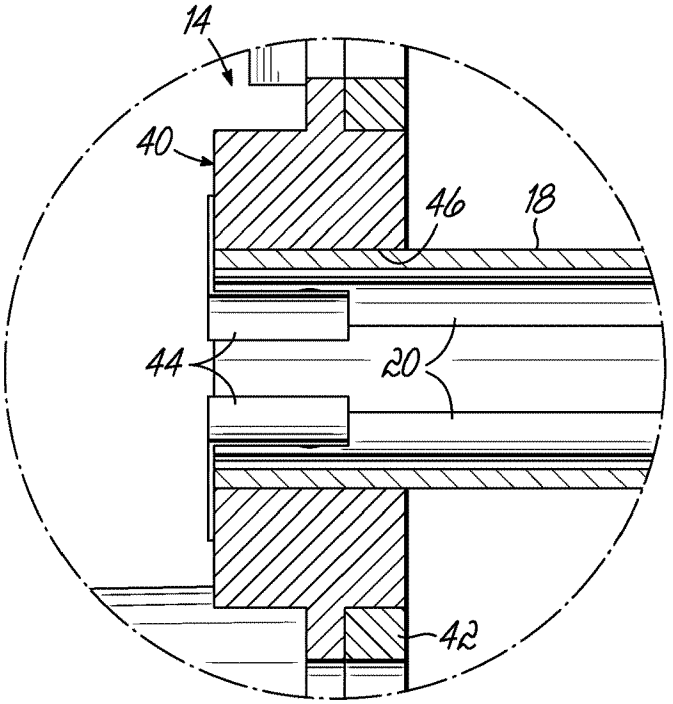
FIG. 7 is an enlarged cross-sectional view showing the connection between the tube and the electrical connector associated with the outer housing or panel.

The fully-assembled electro-mechanical lock 10 of this embodiment is shown in FIGS. 6 through 8. In this regard, FIG. 6 best illustrates the assembled components using a cross-section along the longitudinal direction of the spindle 16 and tube 18, although it will be appreciated that various components, such as the internal components of the outer lock component 14 and the internal components of the inner lock component 12, have again been removed for clarity. The tube 18 contains multiple electrical conductors 20 extending along its inner diameter/surface as shown in FIG. 6. These electrical conductor/pathways 20 may, for example, be of any desired or required number and positioned at any angular spacing. As shown, there are four representative electrical conductors 20 spaced at about 90 degree increments (e.g., about equally in this embodiment) about the internal circumference of the tube 18. These electrical conductors 20 physically and electrically couple with the respective electrical contacts 34, 44 of the two previously described electrical connectors 30, 40.

The tube 18 may, for example, be constructed in an exemplary embodiment from a combination of fiberglass or another sheet material and epoxy resin. The fiberglass sheet material may be wrapped around a cylindrical mandrel and the electrical conductors 20 may comprise copper or other electrically conductive metallic elements that are physically fixed to the fiberglass sheet material prior to the sheet material being wrapped around the mandrel. The electrical conductors 20 may be integrated in or on the tube in any other desired manner. In other embodiments, for example, the electrical conductors 20 may be adhered to the material defining the tube 18 or otherwise physically fixed together instead of being integrally formed as a unitary piece with the tube 18, the electrical conductors 20 may be repositioned from the inner circumference positioning shown in the illustrated embodiment, and/or the tube 18 may be manufactured from other materials such as an extruded plastic material or a formed metallic material, within the scope of this invention. To this end, the electrical conductors 20 being "integrated with" the tube 18 is defined herein as having these elements formed as a one-piece construction that can be cut to size and installed at the lock 10 without requiring management of separate electrical components and tube components. In the illustrated embodiment using the fiberglass and epoxy resin, the epoxy resin is then cured to result in a structurally sound and sturdy tube 18 for containing the spindle 16 (not shown in FIG. 6) and conducting electricity and control signals between the outer lock component 14 and the inner lock component 12. In some embodiments, the tube 18 may be also provided with a foil casing or layer (not shown) to provide RF protection for these elements.

FIG. 6 also illustrates the engagement of the electrical conductors 20 with the first and second electrical contacts 34, 44, which as shown to extend within the tube 18 when the lock 10 is in this fully assembled position. On the right side of FIG. 6 where the inner lock component 12 is shown, the key 52 formed in the first electrical connector 30 is shown extending through the keyway 50 at the top of tube 18. The tube 18 otherwise fully seats within the spindle aperture 36 such that the first electrical contacts 34 extend into the end of tube 18 into engagement with the electrical conductors 20. On the left side of FIG. 6 where the outer lock component 14 is shown, the separate body of the second electrical connector 40 is shown engaged with the outer housing 42 so as to define the spindle aperture 46 that receives the opposite end of tube 18 such that the second electrical contacts 44 are inserted into and engage with the electrical conductors 20. Accordingly, the first and second electrical contacts 34, 44 are brought into operative communication by the electrical conductors 20 integrated into the tube 18.

It will be appreciated that the spindle 16 will not contact the inner surface of the tube 18 or the electrical conductors 20 when positioned centrally within the tube 18. To install the lock 10 with the novel tube 18, the installer needs to measure the required length of the tube 18 based on the door 28 or other access member thickness. The tube 18 is cut to the desired length using a saw or sharp blade at the end of the tube 18 without the keyway 50. The tube 18 is then oriented properly to the first electrical connector 30 of the inner lock component 12 using the key 52 and keyway 50, after the inner lock component 12 is mounted to the door 28. The second end of the tube 18 is coupled to the second electrical connector 40 with the orientation projection 54 extending in the same direction as the lock bolt 24. The outer lock component 14 is installed at the door 28 to complete the process.

FIG. 7 illustrates in further detail the physical and electrical connection between the tube 18 and the second electrical connector 40 associated with the outer lock component 14 shown in FIG. 6, including the physical and electrical couplings between the second electrical contacts 44 and the electrical conductors 20 integrated into the tube 18. It will be understood that the other end of the tube 18 makes a similar contact arrangement with the first electrical connector 30 in this embodiment. If the electrical conductors 20 are redesigned or repositioned as noted above in alternative embodiments, the first and second electrical connectors 30, 40 will also be redesigned to match the structure of the tube 18.

FIG. 8 illustrates in a perspective view from a bottom side the connection between the opposite end of the tube 18 and the first electrical connector 30 of the inner lock component 12. This first electrical connector 30 may be more integrated into the inner housing 32 as set forth in detail above, and it includes orientation structure, such as in the form of a projecting key 52 that slides within the keyway 50 at the end of the tube 18. It will likewise be appreciated that any other suitable orientation structure may be provided or that orientation indicia may alternatively or additionally be provided to ensure that the installer properly orients the electrical conductors 20 of the tube 18 with respect to the corresponding electrical contacts 34, 44 associated with the inner and outer housings 32, 42.

Thus, by installing and using the electro-mechanical lock 10 of the present invention, the electrical and control connections provided between inner and outer lock components 12, 14 can be improved over conventional designs. To this end, the integrated construction of the tube 18 with the electrical conductors 20 is more cost-efficient and reliable to install than the conventional double tube arrangement. For example, the tube 18 of the lock 10 is easily cut to size without damaging the electrical conductors 20, and the installation process is made easy and reliable as a result of the various orientation features provided. The tube 18 defines a robust, one-piece construction that is less fragile than double tube arrangements used in conventional lock designs. The lock 10 maintains all potential functionality and reliability of the conventional lock designs in which electricity and/or control signals must be transmitted through the door 28, making this design an improvement for circumstances where a high security lock must be installed on the door 28.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. An electro-mechanical lock for a door, comprising:

an inner lock component including a lock bolt movable between extended and retracted positions and a first electrical connector configured to send and receive electrical power and/or control signals, an outer lock component including a lock bolt moving element operatively coupled to a rotatable spindle, a user input device for providing control signals to selectively allow the lock bolt to be moved to the retracted position when a correct code is entered at the user input device, and a second electrical connector configured to send and receive electrical power and/or control signals, and a tube extending between the inner lock component and the outer lock component, wherein the spindle extends through the tube when the lock is fully assembled, and the tube includes at least one electrical conductor integrated with the tube as a one-piece construction and configured to transmit electrical power and/or control signals between the first and second electrical connectors.

2. The electro-mechanical lock of claim 1, wherein the at least one electrical conductor is fixed in position on an inner surface of the tube.

3. The electro-mechanical lock of claim 2, wherein each of the first and second electrical connectors includes at least one electrical contact positioned to extend into a corresponding end of the tube when the lock is fully assembled, thereby contacting and operatively connecting with the at least one electrical conductor of the tube.

4. The electro-mechanical lock of claim 3, wherein a plurality of electrical conductors is provided on the tube and a plurality of electrical contacts are provided at each of the first and second electrical connectors.

5. The electro-mechanical lock of claim 4, wherein the plurality of electrical conductors is spaced around a circumference of the tube.

6. The electro-mechanical lock of claim 4, wherein the tube and the first and second electrical connectors include orientation structures that ensure that the electrical contacts are properly engaged with the electrical conductors of the tube when the lock is fully assembled.

7. The electro-mechanical lock of claim 6, wherein the orientation structures include a key extending from one end of the tube or the first electrical connector and a keyway formed in the other of the one end of the tube or the first electrical connector, the key and keyway configured to engage one another only when the tube is properly oriented relative to the first electrical connector.

8. The electro-mechanical lock of claim 6, wherein the orientation structures include an orientation projection extending from the second electrical connector in the same direction as the lock bolt extends from the inner lock component when the lock is fully assembled.

9. The electro-mechanical lock of claim 6, wherein the orientation structures are located along only along a first end of the tube such that an opposite second end of the tube can be cut to match a thickness of the door.

10. The electro-mechanical lock of claim 1, wherein the at least one electrical conductor and the tube are integrally formed as a unitary piece to provide the one-piece construction.

11. The electro-mechanical lock of claim 10, wherein the tube is formed from at least one of a fiberglass and epoxy structure, an extruded plastic material, or a metallic material, and the at least one electrical conductor further comprises at least one metallic element extending along a length of the tube.

12. The electro-mechanical lock of claim 1, wherein the at least one electrical conductor and the tube are physically fixed together to provide the one-piece construction.

13. The electro-mechanical lock of claim 1, wherein the outer lock component includes a dial defining both the lock bolt moving element and the user input device.

14. The electro-mechanical lock of claim 1, wherein the outer lock component further comprises a display unit configured to provide feedback to a user regarding whether the correct code has been entered.

15. The electro-mechanical lock of claim 1, wherein the user input device of the outer lock component is defined by a touch pad.

16. A method of installing an electro-mechanical lock on a door, comprising:

positioning an inner lock component on an inner side of the door, the inner lock component including a lock bolt, positioning an outer lock component on an outer side of the door, extending a tube between the inner lock component and the outer lock component, the tube including at least one electrical conductor integrated with the tube as a one-piece construction, positioning a spindle in the tube to extend through a length of the tube, coupling a first electrical connector to a first end of the tube within the inner lock component, and coupling a second electrical connector to a second end of the tube within the outer lock component, wherein electrical power and/or control signals are directed between the first and second electrical connectors along the length of the tube using the at least one electrical conductor.

17. The method of claim 16, wherein coupling the first electrical connector to the first end of the tube further comprises:

contacting at least one first electrical contact extending from the first electrical connector with the at least one electrical conductor, and aligning the at least one first electrical contact with the at least one electrical conductor by engaging a key formed on one of the first end of the tube and the first electrical connector with a keyway formed on the other of the first end of the tube and the first electrical connector.

18. The method of claim 16, wherein coupling the second electrical connector to the second end of the tube further comprises:

contacting at least one second electrical contact extending from the second electrical connector with the at least one electrical conductor.

19. The method of claim 18, further comprising:

installing the second electrical connector into the outer lock component such that an orientation projection extends in a same direction as the lock bolt, which assures alignment of the at least one second electrical contact with the at least one electrical conductor when the lock is fully assembled.

20. The method of claim 16, further comprising:

cutting the tube to match a thickness of the door such that the tube extends between the inner and outer lock components on opposite inner and outer sides of the door.

* * * * *